US007127077B2

(12) United States Patent
Hall et al.

(10) Patent No.: US 7,127,077 B2
(45) Date of Patent: Oct. 24, 2006

(54) ITE HEARING AID AND CONTACT MODULE FOR USE IN AN ITE HEARING AID

(75) Inventors: Matthew Hall, Hellerup (DK); Jesper Kock, Hellerup (DK)

(73) Assignee: Oticon A/S, Smorum (DK)

( * ) Notice: Subject to any disclaimer, the term of this patent is extended or adjusted under 35 U.S.C. 154(b) by 501 days.

(21) Appl. No.: 10/475,879

(22) PCT Filed: Apr. 22, 2002

(86) PCT No.: PCT/DK02/00261

§ 371 (c)(1),
(2), (4) Date: Dec. 12, 2003

(87) PCT Pub. No.: WO02/089524

PCT Pub. Date: Nov. 7, 2002

(65) Prior Publication Data

US 2004/0120538 A1 Jun. 24, 2004

(30) Foreign Application Priority Data

Apr. 25, 2001 (DK) ..... 2001 00654

(51) Int. Cl.
*H04R 25/00* (2006.01)

(52) U.S. Cl. ..... 381/312; 381/323; 381/328

(58) Field of Classification Search ..... 381/312, 381/314, 322, 323, 324, 328, 313
See application file for complete search history.

(56) References Cited

U.S. PATENT DOCUMENTS 4,815,138 A 3/1989 Diethelm
5,347,584 A 9/1994 Narisawa
5,799,095 A 8/1998 Hanright
5,875,254 A 2/1999 Hanright
5,915,031 A 6/1999 Hanright
5,923,764 A 7/1999 Shennib
6,088,465 A 7/2000 Hanright et al.

FOREIGN PATENT DOCUMENTS

WO 9847319 10/1998
WO 0154457 7/2001
WO 03077596 9/2003

*Primary Examiner*—Curtis Kuntz
*Assistant Examiner*—Tuan Duc Nguyen
(74) *Attorney, Agent, or Firm*—Dykema Gossett PLLC

(57) ABSTRACT

This invention regards a hearing aid for at least partial insertion into an ear canal. The hearing aid has a faceplate, a battery holder and a battery and a signal path comprising a microphone, a signal processor, and a receiver, where the microphone and the battery are arranged at the faceplate. Further there are provided one or more electrical contact elements for electrical communication with the signal processor, where the contact elements each has a first leg arranged to be contacted from the outside of the hearing aid and a second leg arranged to provide electrical contact with the signal processor, and an intermediate part embedded in the surrounding material and interconnecting the first and second legs. The first legs of the contact elements are arranged to extend along a first side of the microphone in the space between the microphone and the battery holder and the second legs of the contact elements are arranged at a second side of the microphone. The invention further concerns a separate module with the contact elements where the module also has means for holding the microphone.

7 Claims, 3 Drawing Sheets

ITE HEARING AID AND CONTACT MODULE FOR USE IN AN ITE HEARING AID

AREA OF THE INVENTION

The invention relates to a hearing aid for at least partial insertion into an ear canal, also called an In-The-Ear (ITE) or Completely-In-The-Canal (CIC) hearing aid. The hearing aid has a battery and a signal path comprising a microphone, a signal processor and a receiver, where the microphone and the battery are arranged at the faceplate and where one or more electrical contact elements are provided for electrical communication with the signal processor, where the contact elements each comprise a fist leg arranged to be contacted from the outside of the hearing aid and a second leg arranged to provide electrical contact with the signal processor and an intermediate part embedded in the surrounding material and interconnecting the first and second legs.

The invention further relates to a contact module for use in an ITE hearing aid where one or more contact elements are arranged in a separate module adapted for connection with the faceplate.

BACKGROUND OF THE INVENTION

In hearing aids of the above mentioned type, it is of the outmost importance, that the faceplate of the finished hearing aid has the smallest possible size, as hearing aid users prefer small hearing aids. The limiting factor are the components associated with the faceplate as they determine to what extend the faceplate may be cut and minimized during manufacture, and the cut faceplate determines to what extend the hearing aid will protrude from the canal of the ear. A number of different elements are arranged at the faceplate, such as the battery, the microphone and contact elements for providing electrical contact with the components of the hearing aid. Especially when the hearing aid contains a programmable signal-processing unit, these contact elements are necessary in order to provide electrical contact with the programmable unit. The contact elements are usually arranged near the battery holder, and are available for electrical contact from the outside.

In one example of prior art the battery holder, the contact elements and the microphone are arranged in line in the mentioned order at the faceplate. The contact elements are lodged in the faceplate during the molding thereof, whereby a first leg is available from the outside through the battery holder opening, and a second leg is available for soldering a wire thereto. The two legs are usually spaced somewhat apart and have a conductor part between the two, which is lodged in the material of the faceplate. It is further known to arrange the contact elements in a separate module, and provide means in the faceplate for holding this module. In both constructions space must be available for both the contact elements and the microphone.

These constructions are space consuming, and further miniaturization is not possible.

Based on this a first objective of the present invention is to provide a hearing aid, which has a faceplate adapted for manufacturing of smaller size hearing aids.

A further objective is to provide a contact module for a hearing aid, which will enable the manufacturing of a smaller size hearing aid.

SUMMARY OF THE INVENTION

The hearing has a faceplate, which is adapted for smaller size manufacturing such that the cut faceplate of the hearing aid is small and does not protrude from the users ear.

By means of the defined construction in which the first legs of the contact elements are arranged to extend along a first side of the microphone in the space between the microphone and the battery holder and the second legs of the contact elements are arranged at a second side of the microphone a very compact construction is provided. The first and second legs are interconnected by the intermediate parts, which are caused to extend around the microphone and are embedded in the material surrounding the microphone. An extension of this conductor is left to protrude from the material at a place suitable for soldering the connectors. This protruding part of the connection element then forms the second leg. As the first legs extend along the first side of the microphone in the space between the microphone and the battery holder the fist legs consume a minimum of space.

In a preferred embodiment the material surrounding the microphone is a separate module wherein the contact elements are fixed. The separate module has means for holding the microphone. The microphone and the module may be separable, which makes exchange of the microphone easy, or they may form an inseparable unit, which is mounted in the faceplate. In the faceplate means are provided in order to receive the module to be retained in a fixed position. The advantage of the separate module also lies in the possibility to choose a material with properties superior to those of the faceplate, e. g. better temperature resistance. In one embodiment thermoplastic with a high melting point is chose, whereby soldering wire connections at the second legs of the contact elements can be done without harming the material surrounding the leg.

In a further embodiment the holding means at the separate module are arranged to retain the microphone in an inclined relation to the faceplate. Thereby it becomes possible to produce a hearing aid, wherein that part of the hearing aid, which is placed in the canal, may start right behind the faceplate. In this way it is possible to further decrease the protrusion of the hearing aid from the canal. This is highly desired among hearing aid users, and for this reason, even small improvements will be of importance.

In an embodiment according to claim 4, the first and second legs of each of the contact elements are arranged at each their side of the microphone, whereby the conductors pass over a front end of the microphone. This ensures that the soldering points of the wires, which are to electrically connect the second legs with the signal processor, are well out of the way of the moving parts of the battery holder. In this way the wires do not become entangled or damaged by the movements of the battery holder.

The further objective of the present invention namely to provide a contact module for a hearing aid, which will enable a smaller size manufacturing of the hearing aid is achieved by means of the contact module as defined in claim 5. This claim defines a contact module for use in an ITE hearing aid wherein one or more contact elements are fixed each with a first leg arranged to be contacted from the outside of the hearing aid and with a second leg arranged to provide electrical contact with the components of the hearing aid and an intermediate part embedded in the material of the module and interconnecting the first and second legs, whereby the contact module is a separate module and adapted for connection with the faceplate and wherein the separate module comprise means for holding a microphone.

By means of the defined construction of the contact module a significantly smaller hearing aid may be produced when the contact module is arranged in the faceplate and the cosmetically attractiveness of the hearing aid will be enhanced.

This is achieved by way of the separate module, which allows the integration of the microphone and the contact elements in a very compact construction. The microphone and the contact elements are then inserted in the faceplate and retained here by suitable means. The module further allows quick and straightforward remakes of ITE hearing aids. In some cases the shells of ITE hearing aids do not fit the users ear, and the hearing aid must be remade. In this case a new shell is produced and a new faceplate is mounted thereon. With the use of the module re-soldering microphone and programming connections is no longer necessary, as the module may simply be removed from the old faceplate and inserted in the new faceplate.

The first legs of the contact elements are arranged to extend along a first side of the microphone and the second legs of the contact elements are located at a second side of the microphone opposite the first side. By separating the first and second legs of the contact elements it is ensured, that the wires which are to lead from the second legs to the signal processor are well out of the way of the moving parts of the battery holder.

In an embodiment the intermediate part of each contact element extend over the front end of the microphone and one of the intermediate parts passes around a soundpassage arranged for conducting the incoming sound to the microphone. An aperture in the front end of the microphone is necessary for leading the sound to the active element of the microphone. One of the contact elements has an intermediate part, which is going to pass over the front of the microphone in the area of the soundpassage. It is suggested according to the claim that this intermediate part is formed to pass around the soundpassage of the microphone. Preferably the intermediate part has an aperture where through the soundpassage is led.

The invention will be described more detailed in the following description of a preferred embodiment, with reference to the drawings.

DESCRIPTION OF A PREFERRED EMBODIMENT

Figure 1:
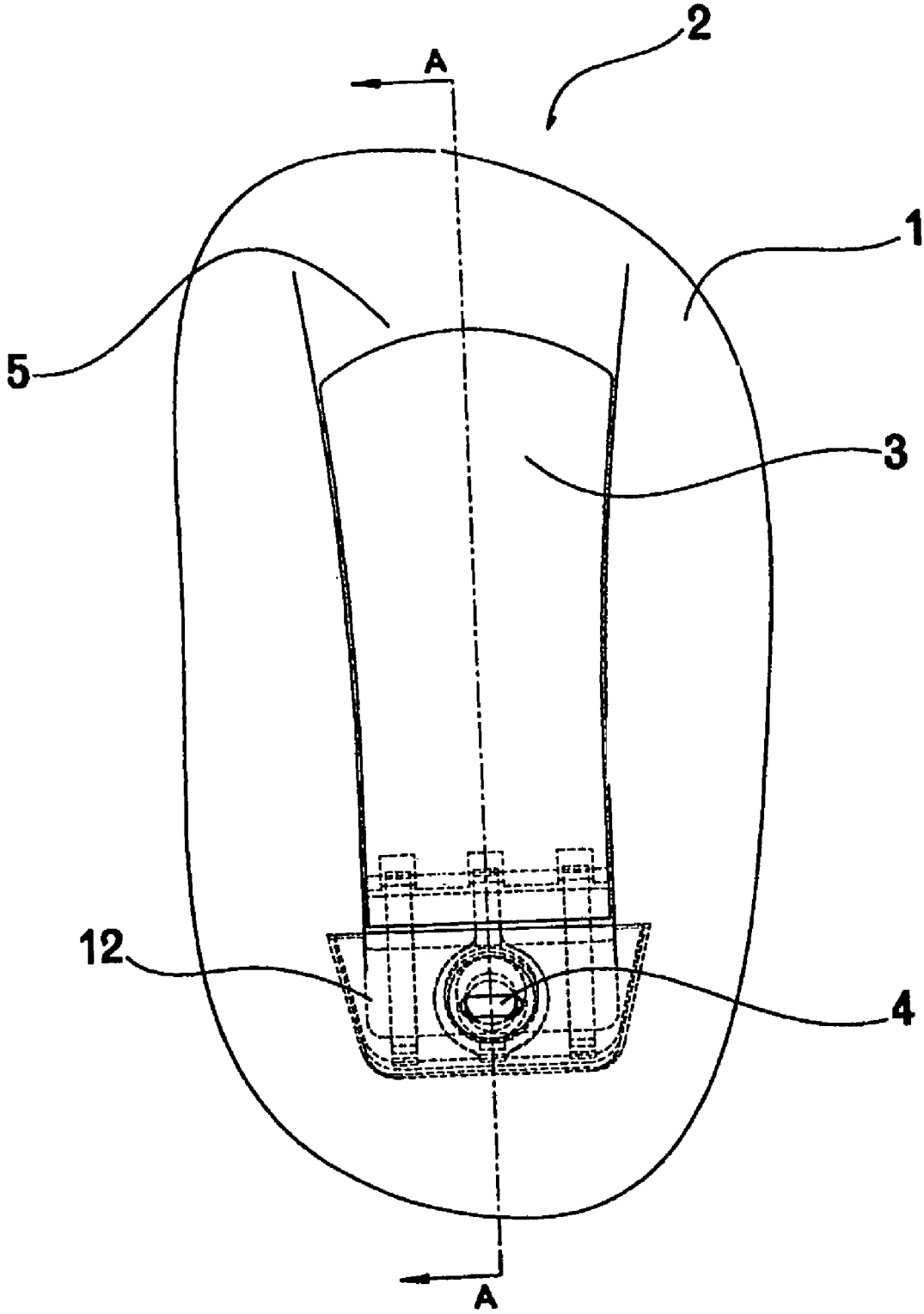
FIG. 1 is a front view of an ITE hearing aid according to the invention.

In FIG. 1 the faceplate 1 of the ITE hearing aid 2 is shown in a front view. The faceplate 1 has a battery holder 3 and an opening 4. Behind the opening 4 a microphone 12 is placed. The battery holder 3 has a lid 5 hinged to the faceplate 1 by way of a hinge pin 15 visible in FIGS. 2 and 3. Inside the hearing aid a signal path with a signal processor (not shown) is provided from the microphone 12 to the receiver (not shown).

Figure 2:
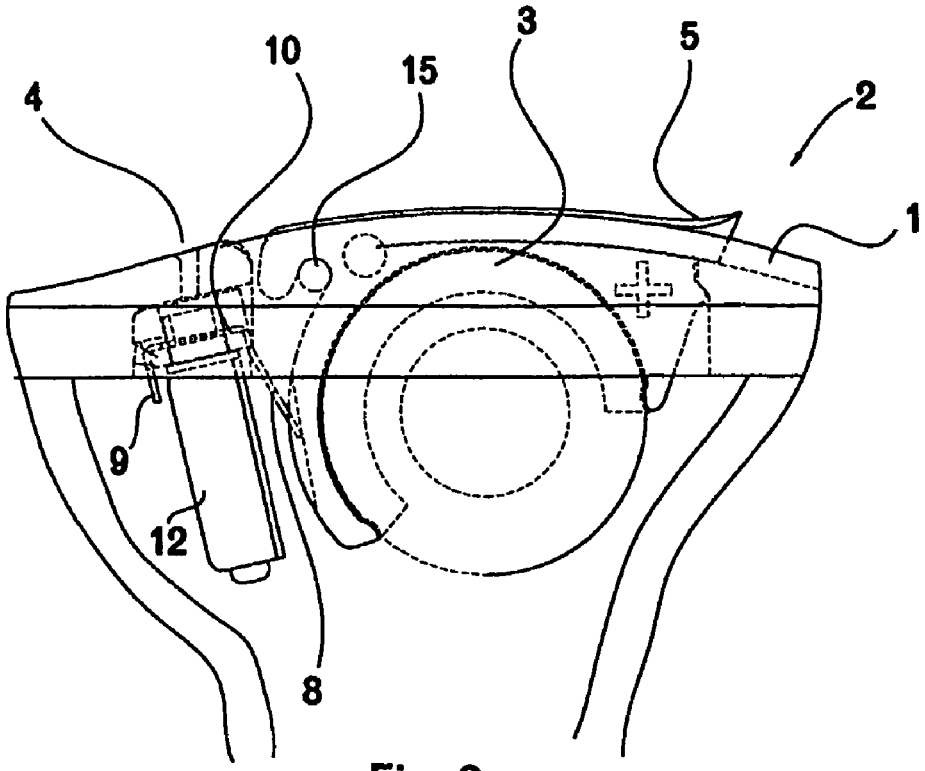
FIG. 2 is a side view of an ITE hearing aid according to the invention.
Figure 3:
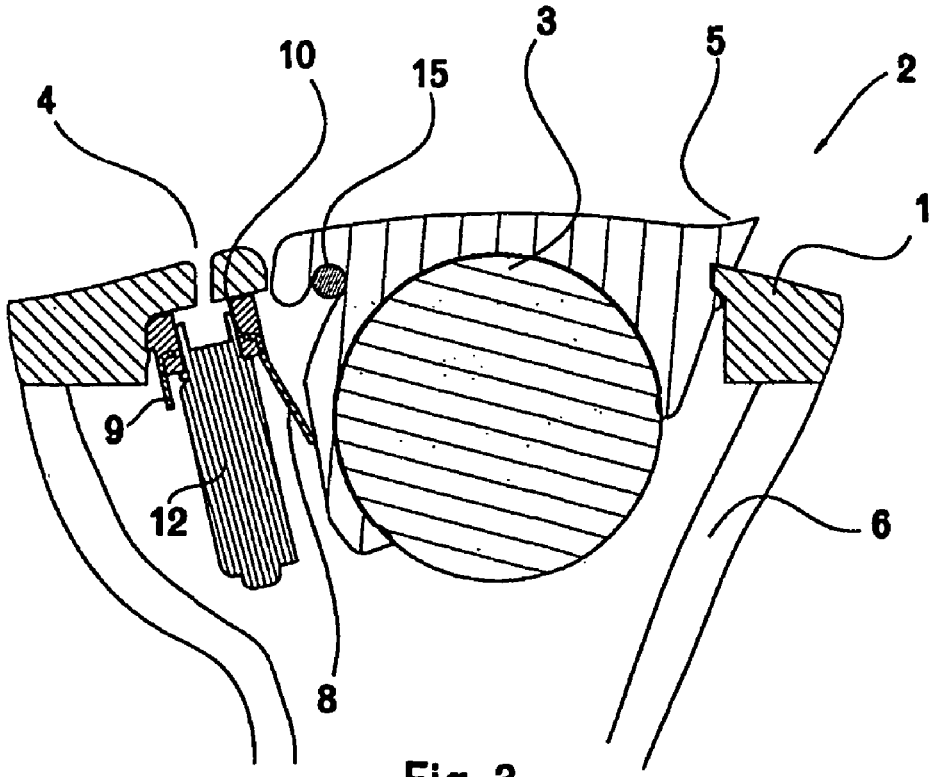
FIG. 3 is a sectional view of a hearing aid along the line A—A in FIG. 1.

In the side view of the hearing aid 2 in FIG. 2 and in the sectional view of FIG. 3, the faceplate 1 is connected to a shell part 6. This shell part 6 is to be placed in the ear canal of the user, so that only the faceplate 1 is visible from the outside. In this connection it is well known that hearing aid users wish their hearing aids to be as invisible as possible, and therefore hearing aid providers seek to make the faceplates as small as possible. However certain parts of the hearing aid are fastened at the faceplate, namely the battery holder 3, the microphone 12 and the contact elements. The contact elements are necessary in order to provide electrical contact with the electronic parts of the hearing aid. Typically the contact elements are used to supply programming signals for a programmable signal processor, which forms part of the signal path between the microphone 12 and the receiver. In a commonly used standard for the contact elements, these are placed behind the hinge pin of the battery holder lid 5. Connection from the outside can be obtained by means of a flexible cable, which is inserted when the battery holder is open and is then squeezed towards the connection elements when the battery holder is closed. Also the battery holder may be designed so that connection form the outside may be obtained without opening the battery holder.

Figure 5:
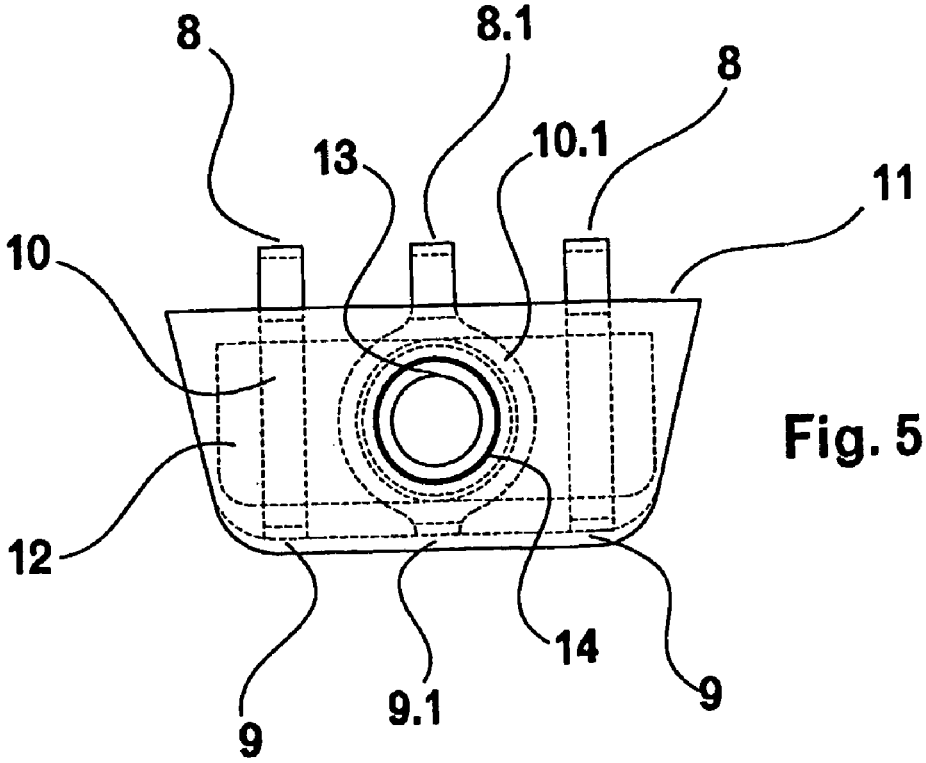
FIG. 5 is a top view of a contact module according to the invention.

Referring to FIGS. 3 and 5 each connection element has a first leg 8, an intermediate part 10 and a second leg 9. The intermediate part 10 is embedded in the material and the two legs 8, 9 protrude from the material at each their side of the microphone 12. The first leg 8 is long in order to provide a spring action against the connection points of the cable, once the cable inserted through the battery holder is squeezed toward the first legs 8 by closing the battery holder lid 5. The second legs 9 are only protruding a short distance out of the surrounding material in order to provide soldering points for wires leading to the signal processor or other electric part of the hearing aid.

The microphone 12 is mounted inclined with respect to the faceplate 1 as seen in FIGS. 2 and 3. This allows the shell 6, which is to be connected to the faceplate to narrow down to the size of the canal of the user right behind the faceplate. Thereby less protruding hearing aids may be produced. An angle of inclination of around 10–15° has been found appropriate. In a preferred embodiment an angle of 12.5° is used.

Figure 4:
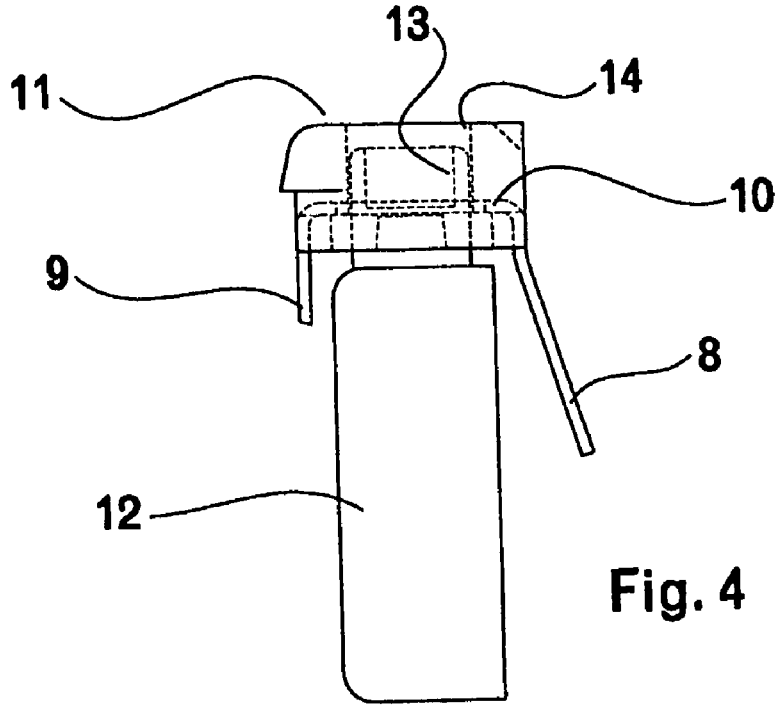
FIG. 4 is a side view of a contact module according to the invention.

In FIG. 4 and 5 the module 11 is shown with the microphone 12, but without the faceplate 1. In the shown embodiment the module and the microphone are glued together, but other ways of connecting the two are possible. When the microphone 12 is placed in the module, the legs 8 will extend along the side of the microphone 12. The intermediate parts 10 of the connection elements are embedded in the material of the module and extend along the surface of the microphone 12 from one side thereof to the other. The first and second legs 8, 9 are placed at each their side of the microphone 12. The microphone 12 has at its front end an orifice 13 through which the incoming sound is led to the microphone 12.

In the module 11 an orifice 14 is provided coaxial with the orifice 13 of the microphone 12. These two orifices are in line with the opening 4 in the faceplate 1 once the module 11 with the microphone 12 is mounted in the faceplate 1. In the displayed embodiment of the invention there are three connection elements, and they are placed side by side. The one in the middle 8.1, 9.1, 10.1 has an intermediate part 10.1 passing over the front end of the microphone 12 in the area of the orifice 13. Therefore the intermediate part 10.1 of the connection element in the middle is constructed to pass around the orifice. In an embodiment as seen in FIG. 5 the connection element has an aperture where through the orifice 13 may pass.

The microphone may have a thin insulation layer at both sides in order to prevent short circuits.

The invention claimed is:

1. A hearing aid for at least partial insertion into an ear canal and having a faceplate (1), where the hearing aid (2) has a battery holder (3) and a battery and a signal path comprising a microphone (12), a signal processor, and a receiver, where the microphone (12) and the battery are arranged at the faceplate (1) and where one or more electrical contact elements are provided for electrical communication with the signal processor, the contact elements each has a first leg (8; 8.1) arranged to be contacted from the outside of the hearing aid (2) and a second leg (9; 9.1) arranged to provide electrical contact with the signal processor, and an intermediate part (10; 10.1) embedded in the surrounding material and interconnecting the first and second legs, whereby the first legs (8; 8.1) of the contact elements are arranged to extend along a first side of the microphone (12) in the space between the microphone and the battery holder (3) and whereby the second legs (9; 9.1) of the contact elements are arranged at a second side of the microphone (12).

2. A hearing aid according to claim 1, where the electrical contact elements are fixed in a separate module (11) adapted for connection with the faceplate (1) and where the separate module (11) comprise means for holding the microphone (12).

3. A hearing aid according to claim for 1, where the microphone (12) is retained in an inclined relation to the faceplate (1).

4. A hearing aid according to claim 1, wherein the first and second legs of each of the contact elements are arranged at opposite sides of the microphone (12) and whereby the intermediate parts (10; 10.1) pass over a front end of the microphone (12).

5. A contact module for use in an ITE hearing aid wherein one or more contact elements are fixed each with a first leg (8; 8.1) arranged to be contacted from the outside of the hearing aid (2) and with a second leg (9; 91) arranged to provide electrical contact with the components of the hearing aid (2), and an intermediate part (10; 10.1) embedded in the surrounding material and interconnecting the first and second legs, whereby the contact module (11) is a separate module and adapted for connection with the faceplate and wherein the separate module (11) comprise means for holding a microphone (12).

6. A contact module according to claim 5, where the first legs (8; 8.1) of the contact elements are arranged to extend along a first side of the microphone (12) and the second legs (9; 9.1) of the contact elements are located at a second side opposite the first side of the microphone (12).

7. A contact module according to claim 6, where the intermediate part (10; 10.1) of each contact element extend over the front end of the microphone (12) and where one of the intermediate parts (10.1) passes around a soundpassage (13) arranged for conducting the incoming sound to the microphone (12).

* * * * *